US009770137B2

(12) United States Patent
Berke

(10) Patent No.: US 9,770,137 B2
(45) Date of Patent: Sep. 26, 2017

(54) LOCKING SHOWER CADDY

(71) Applicant: Berke, Inc., South Setauket, NY (US)

(72) Inventor: Tal Berke, South Setauket, NY (US)

(73) Assignee: Tula Industries, LLC, South Setauket, NY (US)

( * ) Notice: Subject to any disclaimer, the term of this patent is extended or adjusted under 35 U.S.C. 154(b) by 0 days.

(21) Appl. No.: 14/587,305

(22) Filed: Dec. 31, 2014

(65) Prior Publication Data

US 2015/0182076 A1 Jul. 2, 2015

Related U.S. Application Data

(60) Provisional application No. 61/922,666, filed on Dec. 31, 2013.

(51) Int. Cl.

| | |
|---|---|
| ***A47K 3/28*** | (2006.01) |
| ***A47B 67/00*** | (2006.01) |
| ***A47B 67/02*** | (2006.01) |

(52) U.S. Cl.

CPC ..... *A47K 3/281* (2013.01); *A47B 67/005* (2013.01); *A47B 67/02* (2013.01); *A47B 2067/025* (2013.01); *Y10T 29/49826* (2015.01)

(58) Field of Classification Search

CPC ..... A47B 67/00; A47B 67/005; A47B 67/02; A47B 2067/025; A47B 81/00; A47B 81/002; E05G 1/00; E05G 1/005; A47K 3/28; A47K 3/281; A47K 3/30; A47K 3/32; A47K 3/325; A47K 3/001; A47K 3/004; E05B 65/006

See application file for complete search history.

(56) References Cited

U.S. PATENT DOCUMENTS

| | | | | |
|---|---|---|---|---|
| 3,869,183 | A * | 3/1975 | Frank, Jr. | 312/248 |
| 3,894,550 | A | 7/1975 | Eaton | |
| 4,248,398 | A | 2/1981 | Doyel | |
| 4,564,249 | A | 1/1986 | Logsdon | |
| 4,852,920 | A | 8/1989 | DeForrest | |
| 5,143,262 | A * | 9/1992 | Edlund | 222/129 |
| 5,156,450 | A | 10/1992 | Lee | |
| 5,299,683 | A * | 4/1994 | Poole | 206/77.1 |
| D351,751 | S * | 10/1994 | Brightbill | D6/525 |
| 5,452,825 | A | 9/1995 | Comstock et al. | |
| 5,647,651 | A * | 7/1997 | Kim | A47B 96/00 312/209 |
| 5,724,894 | A * | 3/1998 | Knorovsky | 108/42 |
| 5,971,192 | A * | 10/1999 | Immerman et al. | 220/483 |
| 6,003,964 | A * | 12/1999 | Baker | 312/206 |
| 6,431,386 | B1 * | 8/2002 | Hofman et al. | 220/481 |
| 8,207,816 | B2 | 6/2012 | Crigger et al. | |
| 8,215,064 | B2 * | 7/2012 | Diacono | 52/34 |

(Continued)

OTHER PUBLICATIONS

International Search Report and Written Opinion in PCT/US2014/072966.

*Primary Examiner* — Andrew Roersma
(74) *Attorney, Agent, or Firm* — Ted Whitlock

(57) ABSTRACT

A mountable shower/bath storage caddy or container which is securable or lockable for securely storing a bottled personal hygiene item such as a bottle of shampoo, which is only accessible to a person having a code or key to unlock the container. A method of using the container and system of multiple containers for shared shower or bath enclosures are also provided.

4 Claims, 7 Drawing Sheets

(56) References Cited

U.S. PATENT DOCUMENTS

| | | | | |
|---|---|---|---|---|
| 8,479,956 | B2 | 7/2013 | Lewis, II | |
| 2006/0026751 | A1* | 2/2006 | Matthews | A47K 3/282 4/611 |
| 2007/0267949 | A1* | 11/2007 | McCarty | 312/107 |
| 2008/0052816 | A1* | 3/2008 | Gillis | 4/559 |
| 2008/0111454 | A1* | 5/2008 | Spoljaric | A61F 17/00 312/209 |
| 2009/0015121 | A1* | 1/2009 | Sampson | 312/242 |
| 2009/0044736 | A1* | 2/2009 | Huber et al. | 109/51 |
| 2011/0001407 | A1* | 1/2011 | Stradiota | 312/237 |
| 2011/0031854 | A1* | 2/2011 | Schwartz | A47B 67/02 312/227 |
| 2011/0219695 | A1* | 9/2011 | Ivasiv | E05C 3/042 49/394 |
| 2012/0068587 | A1* | 3/2012 | Pantoja et al. | 312/242 |
| 2014/0265768 | A1 | 9/2014 | Diemel | |

* cited by examiner

LOCKING SHOWER CADDY

BACKGROUND OF THE INVENTION

The present invention relates to a shower/bath storage caddy or container, and preferably, to a shower-mountable caddy or container or cabinet which is securable or lockable whereby the stored contents are only accessible by the owner or person having authorized access to the locked container and contents thereof.

Portable carrying cases or caddies, exist that can be used for holding and storing personal hygiene items, and which are carried to and from the shower or bath for individual use, allowing the user to prevent use of the personal hygiene items by others using the same bath or shower. Such caddies and containers are typically "open" containers which offer no protection from their contents being used or tampered with by other individuals with access to the caddy or the shower/bath.

In addition, cabinets or storage containers for storing personal hygiene supplies or medicines, and which have a panel, such as a hinged or sliding door for accessing the contents stored therein, are known. Such cabinets, which can be wall-mounted and can include a plurality of shelves, are commonly referred to as "medicine cabinets." However, medicine cabinets, though typically mounted in a bathroom, are not adapted for use within in a shower stall or bath area where they can become wetted or dampened by shower or bath water.

Finally, containers or dispensers for personal hygiene compositions, such as liquid soap, shampoo, hair conditioner, and the like, which are mountable to a shower or bath wall, are known. For example, U.S. Pat. Nos. 4,248,398; 5,452,825; and 8,479,956 describe wall-mountable containers and fluid dispensers for liquid soap, etc., having a chamber or plurality of valved chambers from which the liquid contents are accessed by opening the valve. However, these dispensers cannot hold a bottled soap or shampoo and require re-filling of a reservoir. Moreover, these dispensers do not regulate or restrict use by any particular individual and permit access to the contents by any user.

A problem exists where a single bath or shower is used by multiple individuals, and access to personal hygiene items stored in the bath or shower area is not restricted. For example, this problem can occur in large households, student housing, apartments or the like, where a single bath or shower or single bath or shower area is shared by multiple users who do not want their expensive personal hygiene or cleansing items, such as shampoo, conditioner, bar soap, razor, loufa, or the like, used by others.

It can be inconvenient to use a caddy to carry shampoo, soap, razors, or other personal hygiene items to and from the shower area for each use. Moreover, storage or "medicine" cabinets which do not lock or are not adapted for use within a shower or tub area are insufficient for storing an individual's personal hygiene items and restricting access to such items by others.

A locking cabinet, cabinet, container, or cabinet, which restricts access by others, and can be stored in the shower area, in accordance with the subject invention, can address the existing problems as described.

SUMMARY OF THE INVENTION

The present invention relates to a lockable shower/bath storage caddy or container, preferably, to a mountable caddy or container comprising a locking means for securing the contents of the caddy and which provides access to the user of said container having a key or combination to the locking means.

The present invention provides a lockable container or cabinet for securely holding and storing, within the shower or bath area, personal hygiene items of the end user. The cabinet may be constructed from a variety of waterproof materials including plastics, metals, and/or wood and which may be directly mounted on a wall of a shower or bathtub enclosure, indirectly mounted by means of a mounting bracket, or can include a hanging means or hook adapted for hanging on the shower pipe, spigot, showerhead, or shower door/wall or shower curtain rod.

The cabinet can be adapted for mounting on a flat wall or corner walls. For example, the back wall of the cabinet can be flat, forming a generally rectangular box, or the back wall or mounting bracket can be generally triangular, conforming to a corner of the shower/tub wall or enclosure.

Advantageously, the cabinet of the invention can be lockable for securely storing personal hygiene items in their merchandized (off-the-shelf) form, meaning that the cabinet can receive and hold a bottle of shampoo or liquid or bar soap as purchased, and not requiring transfer of the contents into a reservoir for later dispensing.

To securely hold the stored contents, a cabinet of the subject invention can include a lockable panel or door. The door can be hinged or can be a sliding door. The locking means can be external to the cabinet, such as a padlock, or can be integral with the cabinet, such as an electronic or battery-operated lock accessible using a code entered into a keypad or fingerprint recognition.

A further advantage of the subject cabinet is that the bottom panel can be porous or perforated, or can include a drain, permitting water to easily exit from the inside of the cabinet following exposure to water during the shower or bath.

DETAILED DESCRIPTION OF THE INVENTION

Figure 1A:
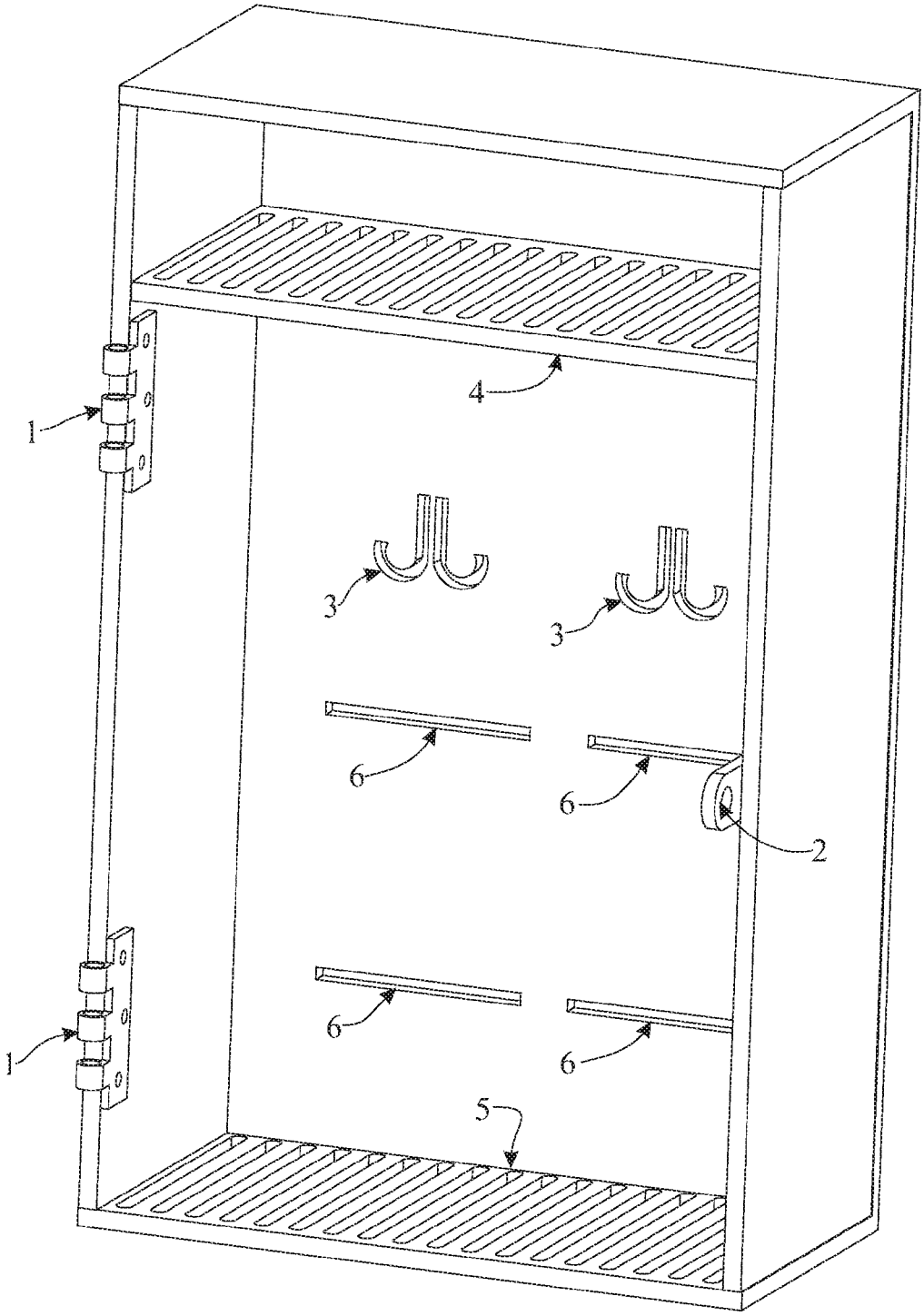
FIG. 1A is a perspective view of an embodiment of a container or cabinet of the subject invention, illustrating side and back walls bounding a chamber or cavity for holding shower or bath items therein, one or more hinges for fastening a door panel (not shown) thereto, and a hasp for securing the door with a padlock.

The present invention relates to a lockable shower/bath storage caddy or container. A preferred embodiment of the subject invention relates to a mountable caddy or container comprising a locking means for securing contents within the caddy and providing access to the contents stored in said container by a user having a key or combination or other authorized access to the locking means.

The storage caddy of the invention provides a lockable container or cabinet for securely holding and storing, within the shower or bath area, personal hygiene items of the end user. The cabinet comprises walls or panels configured to form a rectangular box, for flat-wall mounting, or a triangular box for corner mounting. The walls or panels thus bound a chamber or cavity which is provided in a size appropriate for containing or storing personal hygiene items, such as one or more bottles or canisters of shampoo, hair conditioner, shaving cream, and the like. The chamber or cavity can further include one or more shelves, hooks, or hangers for storing smaller items such as bar soap, razor, shaving cream, tweezers, lotion, scrub, toothbrush, toothpaste, wipes, and the like. A shelf, hook, or hanger can be adjustable, meaning that it can include attachment means allowing for adjusting position of, or completely removing, the shelf, hook, or hanger within the chamber or cavity.

The walls or panels can be constructed from a variety of materials, including plastic or other polymeric material, metal, and/or wood. Preferably, the material forming the walls or panels are waterproof or water resistant, having such property per se, or by being coated with a waterproof or water resistant outer coating to prevent damage from exposure to water in the shower or bath area.

In a preferred embodiment, a container or cabinet of the invention can be directly mounted on a wall of a shower or bathtub enclosure. For example, the container or cabinet can be secured directly to the wall by a fastening means, such as nails, screws, rivets, staples, magnets, suction cups, Velcro®, picture-frame hooks, adhesive, or the like, which affixes the container or cabinet to the wall of the enclosure. A wall or panel of the container or cabinet can include access slots or holes for receiving a fastening means.

Alternatively, a container or cabinet of the invention can be indirectly mounted by means of a mounting bracket which affixes to the wall of the enclosure and affixes to the container or cabinet. Such mounting brackets are well known in the art and can be adapted for various shapes, sizes and weights of containers or cabinets in accordance with the subject invention. Similar to the direct-mounted embodiment, the fasteners for affixing the mounting bracket and/or container or cabinet can be nails, screws, rivets, staples, magnets, suction cups, Velcro®, picture-frame hooks, adhesive, or the like.

Whether directly mounted or mounted by means of a mounting bracket, the cabinet can be adapted for mounting on a flat wall or corner walls. For example, the back wall panel of the cabinet can be flat, forming a generally rectangular box, or the back wall or mounting bracket can be generally triangular in shape, conforming to a corner of the shower/tub wall or enclosure.

Yet another embodiment of the invention is a container or cabinet which comprises a hanging means or hook, adapted for hanging on the shower pipe, spigot, showerhead, or shower door/wall or shower curtain rod.

A further embodiment of the invention comprises a container or cabinet which is adapted to be mounted within the wall of the shower or bath enclosure. This "in-wall" mounted embodiment is similar to an in-wall medicine cabinet, wherein the weight of the cabinet is at least partially borne by the wall. Fastening means can be used for affixing the container or cabinet to wall studs within the wall and/or adhesive, grout, or caulk can be applied to the perimeter of the cabinet to hold the cabinet in place and/or prevent water leakage behind the container or cabinet.

Preferably, the in-wall mounted container or cabinet of the subject invention comprises a port or drain comprising an opening to allow egress of water from the inner chamber or cavity of the cabinet.

Advantageously, the cabinet of the invention can be lockable for securely storing personal hygiene items. Preferably, the personal hygiene items can be placed within the cabinet and stored in their merchandized (off-the-shelf) form, meaning that the cabinet can receive and hold a bottle of shampoo or liquid soap, or other such item as purchased, and not requiring transfer of the contents into a reservoir for later dispensing.

To securely hold the stored contents, a cabinet of the subject invention can include a lockable panel or door. The panel or door can be hinged or can be a sliding door, wherein the door is formed as a flat panel which slidingly engages a slot or track formed or provided in the frame of the container or cabinet. Typically, the lockable door or panel is provided as the front face of the container or cabinet, but can be provided in a side panel.

The locking means can be external to the cabinet, such as a padlock. In this embodiment, a hasp can be provided integral with at least one panel of the container or cabinet, for receiving a padlock used for locking the cabinet. Alternatively, the cabinet can comprise a latch for closing and locking/unlocking the container or cabinet. The latch can be manual, such as a bolt and tumbler mechanism operated by manipulation of a knob or turnkey, or can be electronically, digitally, or battery operated and configured to comprise a digital keypad which electronically operates the locking mechanism. These manual and electronic or digital lock mechanisms are well known in the art and can readily be adapted for use with the subject container or cabinet. Preferably, the locking means is covered or sealed or otherwise made waterproof or water resistant for use in a shower or bath enclosure.

In one preferred embodiment of the subject cabinet, at least one panel, such as the bottom panel, can be porous or perforated, permitting water to easily egress from and exit the inside of the cabinet following exposure to water during the shower or bath. The panels forming the back and side walls of the container or cabinet can be solid or can be porous or perforated. The front panel can be porous or perforated as well, but is preferably solid for aesthetic purposes, such as providing a decorative design thereon, or to hide the contents stored within the container or cabinet.

One embodiment can include a mirrored front panel, and more preferably comprising a steam-resistant mirrored surface, serving as a decorative design or providing a functional purposes such as viewing the face for shaving.

The mirrored surface may alternatively be provided on the inner surface of the front door or panel for use when the door or panel is open.

For an embodiment which is mounted within the wall of the shower or bath enclosure, the walls are solid to prevent water leakage into the wall. Preferably, the bottom panel is slanted downwardly and is configured to form a drain in communication with the exterior of the wall so that water or moisture flows out from inside the chamber or cavity of the container or cabinet.

One or more horizontal shelf, such as a porous or perforated shelf panel can be provided for placement of the personal hygiene contents within the cabinet. Other holders or hangers or hooks can be provided within the cabinet for holding or hanging personal hygiene items, such as a razor, tweezers, toothbrush, toothpaste, and the like.

Turning to the drawings, illustrating certain embodiments of the invention, FIG. 1A shows an assembled rectangular shower/tub-mountable box or lockable/secure personal storage cabinet in accordance with the present invention. While this lockable/secure box will be found suitable for many applications, the particular embodiment shown is intended to be mounted on a flat wall of a shower/tub or shower room and to contain/store one or more, off-the-shelf products such as a shampoo bottle, conditioner bottle and or body wash bottle, which may be taken out of the secure box for use when needed.

The container or cabinet shown in the drawings can vary in size, but is preferably sized for easily storing different standard sizes of shampoo, conditioner or body wash bottles. FIG. 1A shows a rectangular box, with an access door (not shown) that will be attached to the box by hinges 1 and a hasp 2 for receiving a padlock. Hooks 3 are affixed to the back interior wall of the box to hold a razor and/or loufa. The box can further comprise one or more shelf 4, to hold smaller items, such as bar soap. Shelf 4 is shown as being porous or perforated formed having holes or as a grate such that water retention on the surface of the shelf is minimized. One or more panels forming the box can comprise access holes, slots, or apertures 6 for receiving or accessing an attachment means or mounting bracket.

Figure 1B:
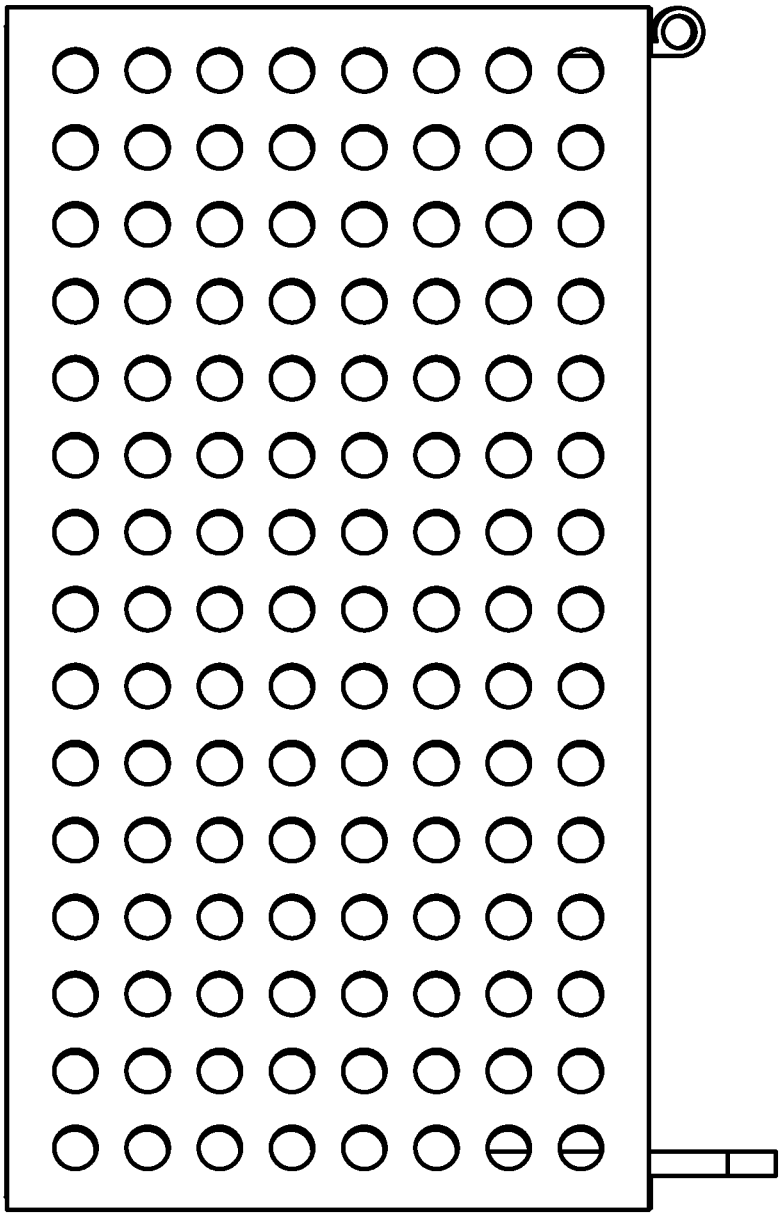
FIG. 1B is a bottom view of an embodiment of a container or cabinet of the subject invention, illustrating a porous bottom panel, such as a plurality of apertures formed in a solid panel allowing egress of water from the chamber or cavity.

Bottom panel 5, where the shampoo, conditioner or body wash bottles stand, can also be provided having a porous/perforated structure to allow water to egress an escape from the inner chamber or cavity of the box. One embodiment of a bottom panel comprising arrayed pores or apertures is illustrated in FIG. 1B.

Figure 2:
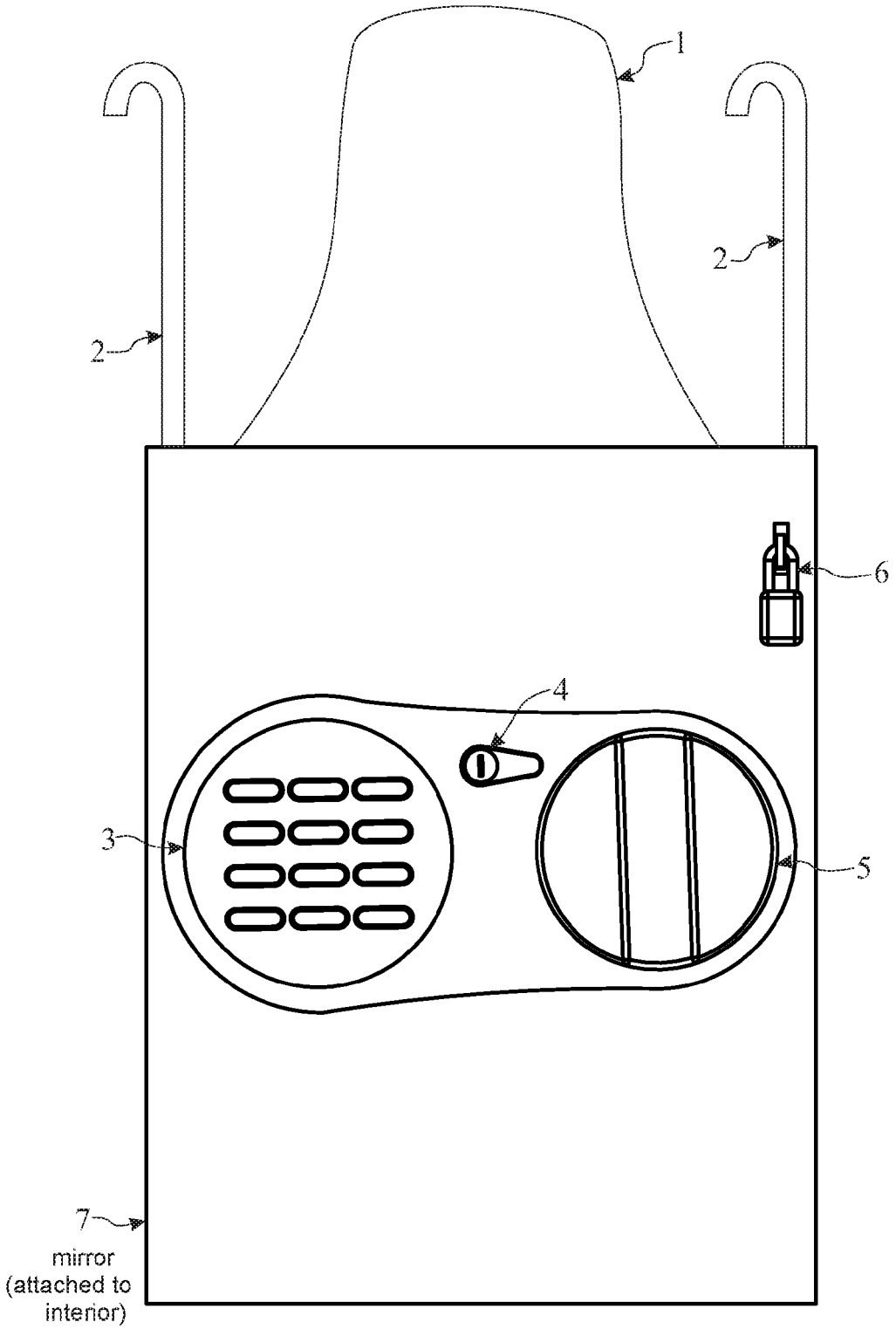
FIG. 2 is a front view of an embodiment of a container or cabinet of the subject invention, illustrating an optional mounting means, namely a hook-type mounting means and an integral digital locking means and knob for securing and opening a securable front panel of the container.

FIG. 2, illustrates an alternative embodiment of a container or cabinet of the invention comprising a hook 1 for hanging the container or cabinet on a shower pipe or spigot. Another alternative embodiment can comprise a laterally disposed pair of hooks 2 to hang the article on a shower door/wall or shower curtain rod. FIG. 2 also illustrates an alternative embodiment of a locking means which can be provided for the container or cabinet of the subject invention. Specifically, shown in FIG. 2 is a front access door/lid/panel which can comprise an electronically or battery operated digital keypad 3 for operation of a lock or latch mechanism 5. Preferably, the keypad is waterproof or comprises a covering for preventing water seepage into the electronics. In the embodiment shown, an alternative or back-up key 4 can be provided for manually locking or accessing the latch. The container or cabinet may also include a hasp for attaching an external padlock thereto. A mirror 7 may be provided or attached to the interior or exterior surface of the front access door or panel.

Figure 3A:
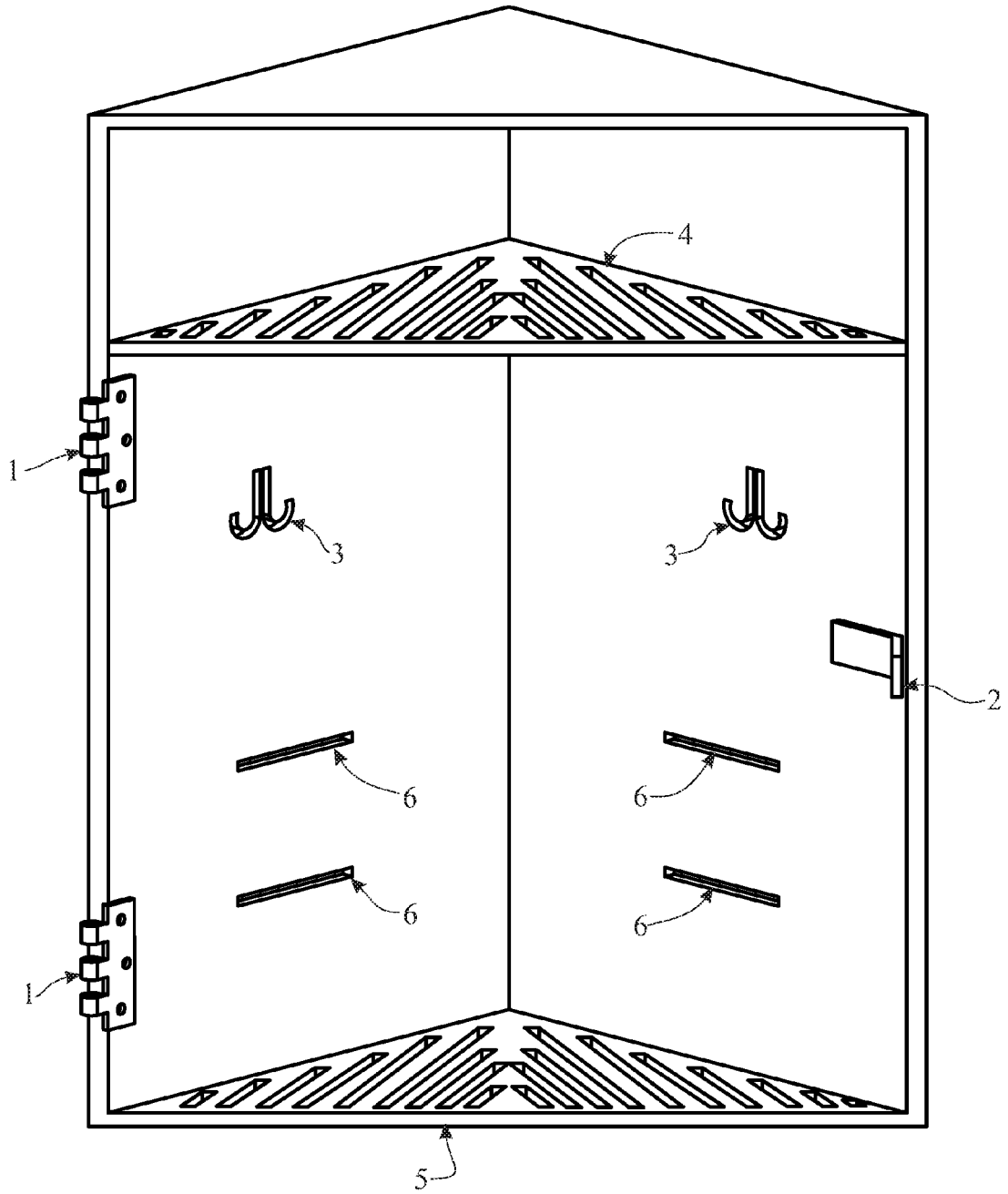
FIG. 3A is a front view of one embodiment of a container or cabinet of the subject invention, illustrating top, bottom and side panels forming a container or cabinet adapted for mounting in a corner of a shower or bath enclosure.

Another embodiment of the invention, namely a triangular shaped box configured for placement in a corner position, is shown in FIG. 3A. Like the rectangular configuration of the embodiment of the invention illustrated in FIG. 1A, FIG. 1B, and FIG. 2, the triangular embodiment of FIG. 3A, can vary in size, (custom sizes—small, medium or large), which can contain/store different standard size shampoo, conditioner or body wash bottles. Moreover, the embodiment shown in FIG. 3A comprises wall panels forming box having a generally triangular-shaped back walls for fitting the box in a corner position, the box panels comprising hinges 1 and a hasp 2 for a padlock.

Hooks or hangers 3 can be affixed or formed integral with the hack interior wall of the box to hold a razor and/or loufa and/or toothbrush, or the like. A shelf 4, to hold small items, such as a bar soap, can be provided for storing such items thereon, wherein the shelf is preferably porous or perforated, or can be a grate material to prevent water from being retained on the surface of the shelf. Bottom panel 5, for holding the shampoo, conditioner or body wash bottles, can also be porous or perforated or be formed from a grate material, to allow water or moisture to escape from the inside chamber or cavity of the box.

Figure 3B:
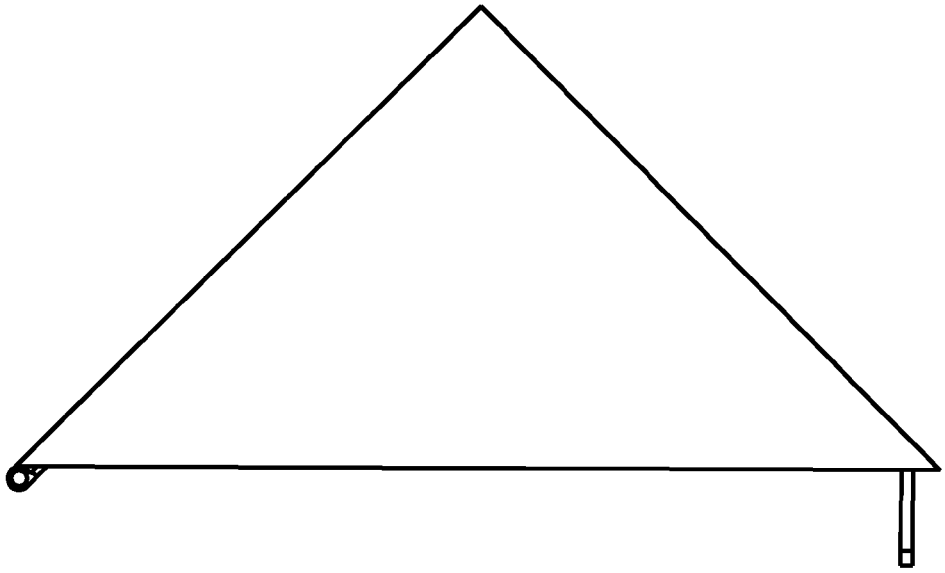
FIG. 3B is a top view of a triangular-shaped container or cabinet of an embodiment of the subject invention as shown in FIG. 3A, illustrating a solid top panel for preventing or resisting water from entering the container or cabinet.
Figure 3C:
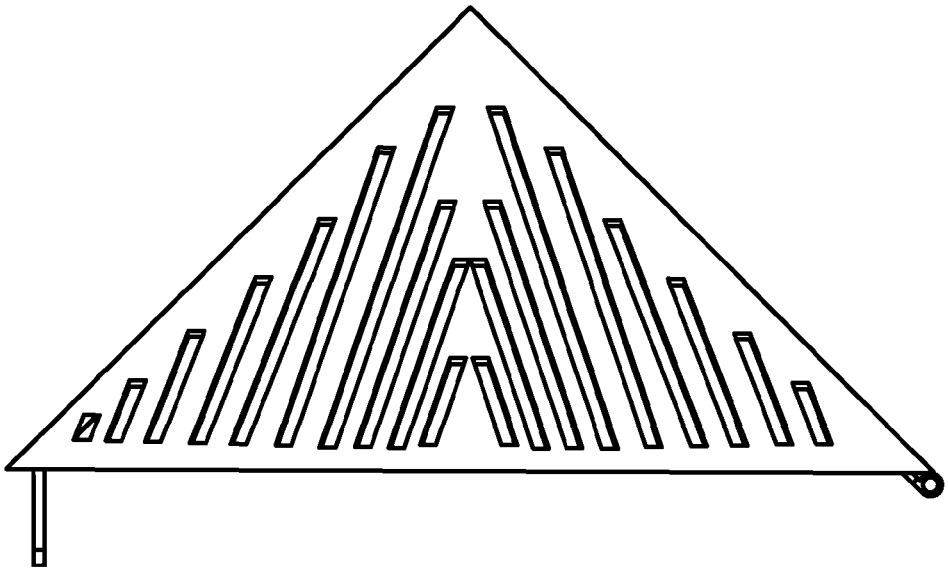
FIG. 3C is a bottom view of a triangular-shaped container or cabinet of an embodiment of the subject invention as shown in FIG. 3A, illustrating a porous bottom panel, shown as a slotted panel, allowing for egress of water or moisture from the chamber or cavity of the container or cabinet.

As further illustrated in FIG. 3A, one or more panels, preferably the back panels, forming the box can comprise access holes, slots, or apertures 6 for receiving or accessing an attachment means or mounting bracket. FIG. 3B illustrates a top panel of a box according to the triangular embodiment of the invention, wherein the panel is preferably solid, which can prevent water from entering the inner chamber or cavity of the box. In addition, as shown in FIG. 3C, a bottom panel of a triangular embodiment of the invention is preferably porous or perforated, or is formed from a grate material, such that water can egress from the inner chamber or cavity of the box.

Figure 4:
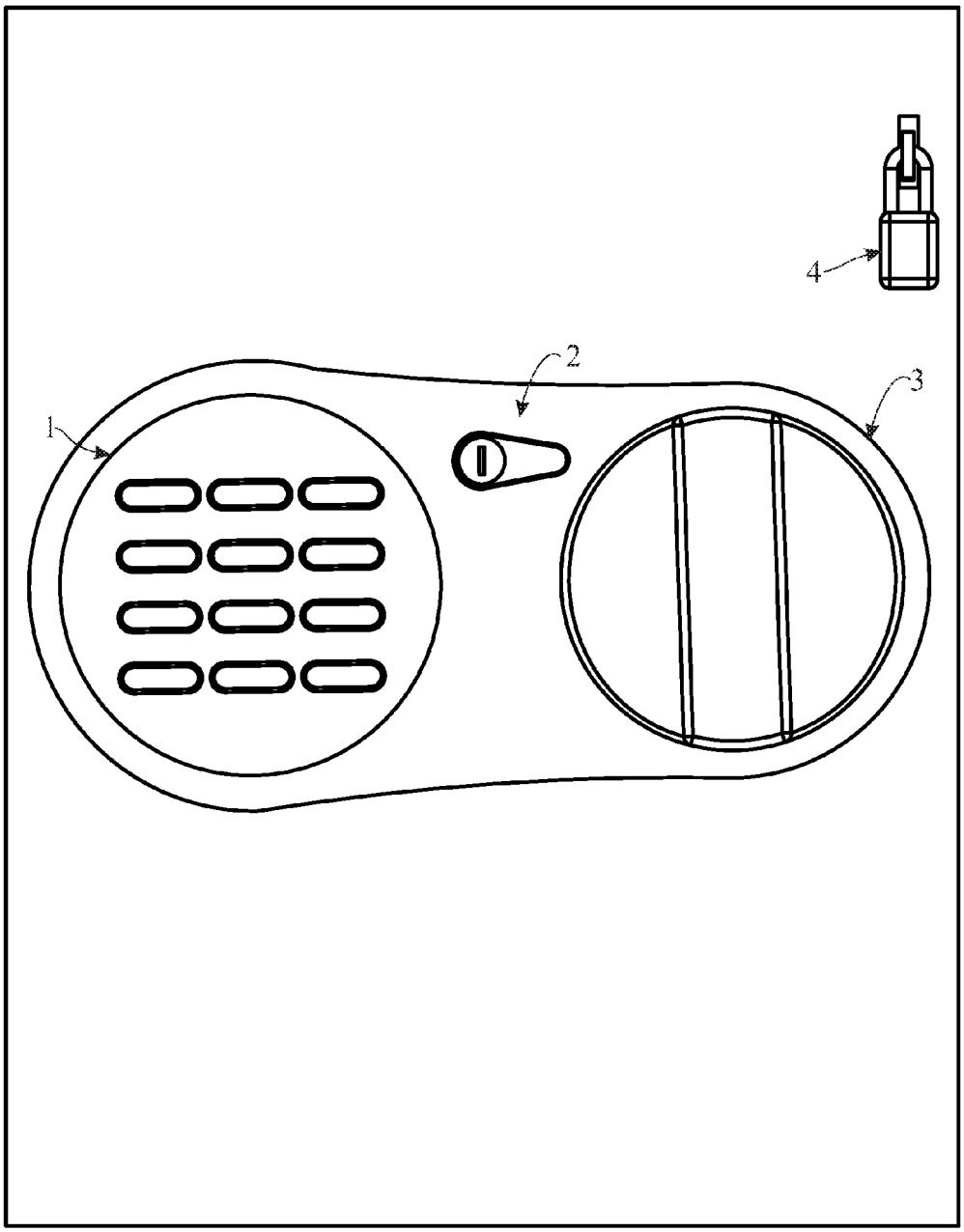
FIG. 4 is a front view of a front panel of a container or cabinet of the subject invention, illustrating an alternative locking means, such as a digital combination lock.

FIG. 4 shows an embodiment of a container or cabinet of the invention comprising a front access door or panel comprising an electronically or battery operated digital keypad 1 for operation of a lock or latch mechanism 3. Preferably, the keypad is waterproof or comprises a covering for preventing water seepage into the electronics. In the embodiment shown, an alternative or back-up key 2 can be provided for manually locking or accessing the latch. The container or cabinet may also include a hasp 4 for attaching an external padlock thereto. It is contemplated that alternative access means, such as fingerprint recognition devices or applications can also be incorporated and used in a locking means for the cabinet of the invention.

Figure 5A:
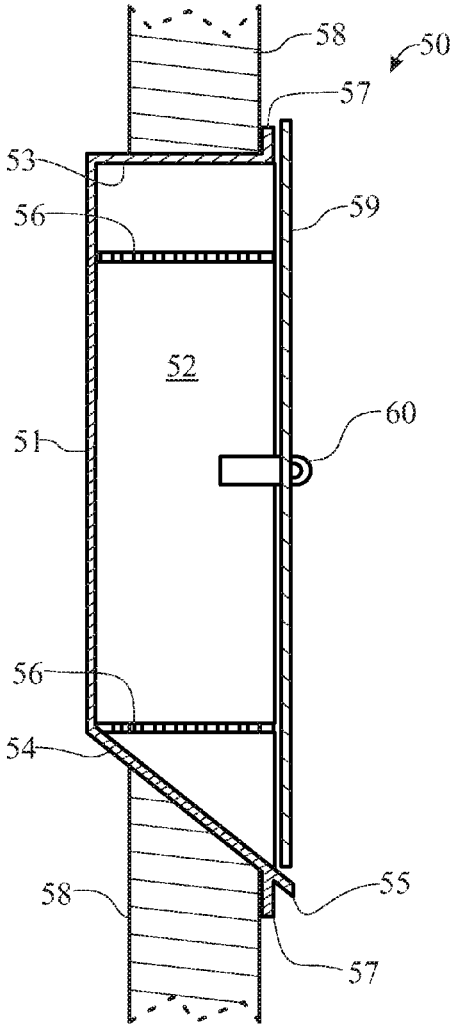
FIGS. 5A and 5B are, respectively, a cross-sectional side view, and front view of an in-wall mounted embodiment of a cabinet in accordance with the subject invention.
Figure 5B:
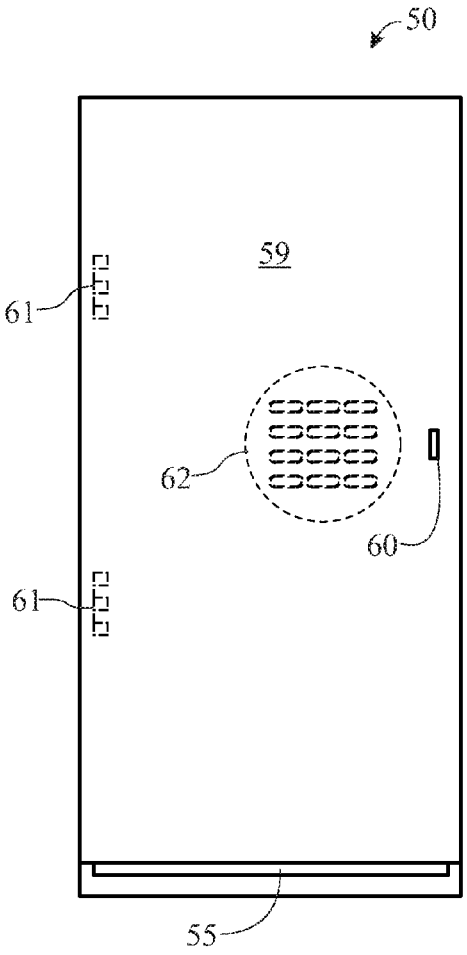

FIGS. 5A and 5B illustrate yet another embodiment of a container or cabinet in accordance with the subject invention, namely an in-wall mountable container or cabinet. The in-wall mountable container or cabinet is generally rectangular, having a substantially flat back wall, two upright side walls, a top wall (ceiling), a bottom wall (floor), and a front door or panel. Preferably, being adapted for mounting inside the wall, the back, sides, top, and bottom walls are formed as a unit, such as an injection molded unit, having a flanged perimeter to contact and sealingly engage the wall surface.

The front panel or door can be formed integral with one of the side panels or can be separately formed and attached by a hinge or sliding means. Preferably, the back, sides, top and bottom walls are solid and are more preferably waterproof.

More specifically, as shown in FIG. 5A, the cross-sectional side view of the in-wall mountable container or cabinet 50 includes a substantially flat back wall 51, side wall 52, top wall 53, and bottom wall 54. Bottom wall 54 is preferably formed having a downward slope, and in communication with a drain 55 allowing for water to drain from the interior chamber of the container or cabinet by force of gravity. The inner chamber can comprise one or more shelves 56, which are preferably porous, or formed from a grate material to prevent water from standing on the surface of the shelf and to egress toward the bottom panel and drain.

More preferably, the outer perimeter of the box comprises a flange for engaging with a flat wall 58. The flange can further be sealed, using an adhesive, caulk, or silicone sealant to sealingly engage the flange to the wall surface, preventing seepage of water into the interior of the wall. Front panel 59 can be hingedly or slidingly affixed to the box, and hasp 60 can be provided for receiving a padlock.

FIG. 5B shows a front view of an in-wall mountable embodiment 50, having a front panel 59 affixed to the box by hinges 61 and configured to receive a padlock by hasp 60. Also shown is drain 55, illustrated as a slotted opening, in communication with the interior of the container or cabinet. An alternative embodiment can comprise a digital keypad 62 (in phantom), which operates a latch (not shown) for accessing and locking the cabinet. The front panel can be solid and can further comprise a mirrored surface.

Having thus described and illustrated the invention, it is hereby asserted that such description and illustrations are in no way limiting, and all variations and embodiments contemplated by the inventor, as would be understood by a person of ordinary skill in the art based on this disclosure hereof, are considered part of and within the scope of the claimed invention without departing from the spirit of the invention so described and claimed.

The invention claimed is:

1. A storage caddy for storing at least one bottled personal hygiene item in a shower or bath enclosure, said caddy consisting of:

a) a rectangular storage cabinet or container formed by back, side, top and bottom walls or panels bounding a chamber or cavity; and b) a front access panel for accessing the chamber or cavity, said front access panel being hingedly affixed to one of the side walls or panels of the storage container or slidingly engaging the top or the bottom wall or panel of the storage container;

said caddy having a combination lock for securing the front access panel to at least one of the side or the top or the bottom walls or panels of the storage container for securing personal hygiene items stored within the storage container and allowing access by a person having authorized access to unlock the combination lock;

wherein the caddy includes at least one suction cup for mounting the caddy in the shower or bath enclosure;

wherein the front access panel, and at least one of the back, the side, the top, or the bottom walls or panels of the caddy, is porous or perforated to allow egress of water or moisture from the chamber or cavity; and wherein said caddy has at least one shampoo shelf capable of holding a standard size shampoo bottle, and optionally, one holding means selected from the group consisting of a hanger, hook, and holder adapted for holding a razor, Loufa, or toothbrush.

2. The caddy of claim 1 wherein the bottom wall and the side walls are porous or perforated to allow for egress of water or moisture.

3. A storage caddy for storing at least one bottled personal hygiene item in a shower or bath enclosure, said caddy consisting of:

a) a rectangular storage cabinet or container formed by back, side, top and bottom walls or panels bounding a chamber or cavity; and b) a front access panel for accessing the chamber or cavity, said front access panel being hingedly affixed to one of the side walls or panels of the storage container or slidingly engaging the top or the bottom wall or panel of the storage container;

c) wherein an inner surface of said front access panel is provided with a mirrored surface;

said caddy having a combination lock for securing the front access panel to at least one of the side or the top or the bottom walls or panels of the storage container for securing personal hygiene items stored within the storage container and allowing access by a person having authorized access to unlock the combination lock;

wherein the caddy includes at least one suction cup for mounting the caddy in the shower or bath enclosure;

wherein the front access panel, and at least one of the back, the side, the top, or the bottom walls or panels of the caddy, is porous or perforated to allow egress of water or moisture from the chamber or cavity; and, wherein said caddy has a shampoo shelf capable of holding a standard size shampoo bottle, and optionally, one holding means selected from the group consisting of a hanger, hook, and holder adapted for holding a razor, Loufa, or toothbrush.

4. A method for securing a bottled personal hygiene item within a shower or bath enclosure, said method comprising:

a. providing a storage caddy for storing at least one bottled personal hygiene item in a shower or bath enclosure, said caddy consisting of:

i) a rectangular storage cabinet or container formed by back, side, top and bottom walls or panels bounding a chamber or cavity; and ii) a front access panel for accessing the chamber or cavity, said front access panel being hingedly affixed to lone of the side walls or panels of the storage container or slidingly engaging the top or the bottom wall or panel of the storage container;

iii) wherein an inner surface of said front access panel is provided with a mirrored surface;

said caddy having a combination lock for securing the front access panel to at least one of the side or the top or the bottom walls or panels of the storage container for securing personal hygiene items stored within the storage container and allowing access by a person having authorized access to unlock the combination lock;

wherein the caddy includes at least one suction cup for mounting the caddy in the shower or bath enclosure;

wherein the front access panel, and at least one of the back, the side, the top, or the bottom walls or panels of the caddy, is porous or perforated to allow egress of water or moisture from the chamber or cavity; and, wherein said caddy has a shampoo shelf capable of holding a standard size shampoo bottle, and optionally, one holding means selected from the group consisting of a hanger, hook, and holder adapted for holding a razor, Loufa, or toothbrush;

b. storing a bottled personal hygiene item within the caddy; and c. locking the front access panel for secure storage or unlocking and opening the front access panel for use of the personal hygiene item.

* * * * *